US005170777A

United States Patent [19]

Reddy et al.

[11] Patent Number: 5,170,777

[45] Date of Patent: Dec. 15, 1992

[54] ARM REHABILITATION AND TESTING DEVICE

[75] Inventors: Narender P. Reddy, Copley; John P. Roman; Jeffrey P. Bulgrin, both of Cuyahoga Falls, all of Ohio

[73] Assignee: The University of Akron, Akron, Ohio

[21] Appl. No.: 635,725

[22] Filed: Dec. 28, 1990

[51] Int. Cl.[5] ..... A61H 1/02

[52] U.S. Cl. ..... 128/25 R; 128/26; 482/44

[58] Field of Search ..... 128/25 R, 26, 77; 272/67; 482/44, 45

[56] References Cited

U.S. PATENT DOCUMENTS

| | | | |
|---|---|---|---|
| 3,937,215 | 2/1976 | Barthlome | 128/26 |
| 4,538,595 | 9/1985 | Hajianpour | 128/25 R |
| 4,559,932 | 12/1985 | Salort | 128/77 |
| 4,671,257 | 6/1987 | Kaiser et al. | 128/25 R |
| 4,809,688 | 3/1989 | Aymerica del Valle et al. | 128/77 |
| 4,811,944 | 3/1989 | Hoff | 272/67 |

*Primary Examiner*—Richard J. Apley
*Assistant Examiner*—Lynne A. Reichard
*Attorney, Agent, or Firm*—Oldham, Oldham & Wilson Co.

[57] ABSTRACT

Disclosed is a motor driven arm rehabilitation device which includes a rotatable forearm support structure capable of being rotated back and forth through a predetermined arc at a predetermined speed and with a predetermined force applied, and a fluid motor such as a rotary actuator for rotating this support structure. Rotation of the supporting structure causes alternate flexion and extension of the patient's arm. The arc of rotation, frequency of rotation and force applied can be varied in accordance with the patient's needs. Associated with the forearm supporting structure is a wrist stabilizer which causes alternate pronation and supination of the wrist as the forearm is alternately flexed and extended. The device also has an upper arm supporting structure.

11 Claims, 5 Drawing Sheets

ARM REHABILITATION AND TESTING DEVICE

TECHNICAL FIELD

This invention relates to arm rehabilitation devices, and more particularly to an automatic arm rehabilitation device which is useful in the rehabilitation of disfunctioning arms of cerebrovascular accident victims as an example.

BACKGROUND OF THE INVENTION

Cerebrovascular accidents have varied causes and consequences. Cerebrovascular accidents include, for example, strokes and head injuries, and can lead to hemorrhage, embolism, thrombosis, and complete or partial loss of function of one or both arms or legs. For example, hemiplegia, or paralysis on one side of the body is a frequent consequence of strokes. Regardless of the cause, cerebrovascular accident victims follow a similar course of rehabilitation. Immediately after the trauma, the muscle tone of the limb usually becomes hypotonic, or flaccid. During this period, there is a tendency for subluxation of the shoulder. Rehabilitation during this period attempts to maintain muscle tone and a full range of motion of the limb. After some time, the muscles may lose their inhibitory forces and become hypertonic, or spastic. This increase in spasticity causes the muscles to contract and follow certain patterns of movement called synergies. Therapy at this point consists of movement of the arm while following these synergies. Therapy of this sort is called "range of motion exercise". Attempts to follow the arm in non-synergy patterns usually results in a spasm, and may cause the patient considerable pain. Most patients stay at this stage, showing varying degrees of spasticity.

The next stage in the rehabilitation process is the breaking of synergies. As the patient loses muscle spasticity and regains voluntary muscle control, he will be able to follow patterns other than the synergies. This process will continue until the patient recovers functional use of his arm. Patient recovery can stop at any point and with varying degrees along this process. Therefore, there are two main categories of patients, with different therapeutic goals.

The flaccid patient has little or no muscle tone; therefore, his goal is to increase muscle tone. The spastic, conversely, has too much tone. In extreme spastic cases, the slightest movement may trigger the spasm, since there is nothing to inhibit muscle contraction. However, a constant stress applied to a muscle is inhibitory to muscle stimulation. The goal of the spastic patient is to decrease muscle tone by constant and slow stretching of the muscles.

In both cases, maintained or increased range of motion is an important goal. Unless range of motion is maintained, permanent shrinkage of the muscles will occur and full use of the limbs will never be regained.

Cerebral vascular victims require numerous hours of therapy during rehabilitation. Often the amount is not optimal due to the workload of the therapist and monetary constraints on either the patient, the hospital or extended care facility, or both. While machines are extensively used for improving arm strength and muscle tone in a healthy person, little attention has been paid to devices or machines for rehabilitation of an arm of a patient who has suffered cerebral vascular trauma. At least one passive range of motion appliance, that shown in U.S. Pat. No. 4,205,666, is known; however, this device requires the patient to supply the power needed to exercise the disabled arm. Only limited improvement is attainable and not all patients would be capable of using such a device. An unmet need, therefore, exists for device which will supply the most basic range of motion exercises necessary for rehabilitation, i.e. elbow extension and flexion, and wrist supination and pronation to achieve the desired rehabilitation in both flaccid and spastic patients.

SUMMARY OF THE INVENTION

Based upon the foregoing, the present invention provides a rehabilitation and testing apparatus for use by patients suffering from flaccid or spastic reaction in the muscles of the arm due to nerve damage as a result of head injury or stroke. The apparatus should provide a means by which the range of motion of the arm can be maintained to preclude atrophy of muscles. In this way, the patient can optimize recovery from the nerve damage by maintaining a full range of motion in the arm in a convenient and accessible manner.

It is therefore a main object of the invention to provide an arm rehabilitation device which may be used to automatically maintain a normal range of motion in a patient's arm recovering from a neurological disease effecting the limb as well as to exercise the limb to prevent atrophy of the muscles therein.

It is yet another object of the invention to provide an apparatus which may be used by a physical therapist to not only maintain a patient's full range of motion, but to also measure or qualify the degree of recovery achieved by the patient during such rehabilitation.

It is another object of the invention to provide a rehabilitation apparatus which is portable and extremely convenient to use by either the therapist or patients themselves, to allow more frequent therapy in a cost-effective manner.

It is yet another object of the invention to provide an apparatus which is adjustable to the size and length of individual arms of patients utilizing the device so as to optimize the benefits gained by usage and to make the device comfortable for the user.

It is yet another object of the invention to provide a rehabilitation apparatus which will automatically move a patient's arm through a full range of motion from full flexion to full extension or more limited ranges of motion at a desired speed and force depending upon the particular attributes or deficiencies of the patient.

It is still another object of the invention to provide a rehabilitation apparatus which will allow the patient or therapist to selectively and precisely control the operation of the apparatus to follow flexor synergies of the patient, or to provide constant stretching or any rehabilitative exercise for rehabilitation of any particular patient suffering from any degree of flaccid or spastic reactions.

It is still another object of the invention to provide a rehabilitation apparatus which precludes or minimizes subluxation of the shoulder.

These and other objects of the invention are accomplished by an arm rehabilitation and testing apparatus which moves the patient's arm and wrist through the flexure synergy in a precise and controlled manner, wherein the speed, force and range of motion are independently controlled to suit the patient's requirements and abilities. The apparatus includes arm supporting means comprising a forearm support having at one end a wrist stabilizer wherein the forearm support is adjustable to accommodate different length arms. The apparatus also includes an upper arm support which securely stabilizes the patient's arm in the proper position for rehabilitation and prevents subluxation of the shoulder. The design of the apparatus ensures that the elbow of the patient is aligned with a pivot point between the upper arm support. The pivot point is the axis of rotation of an output shaft associated with a motor means which imparts motion to the forearm support causing alternate flexion and extension of the patient's forearm about the elbow. In a preferred embodiment, in addition to the kinematic motion of the elbow, the device also follows the kinematic motion of the wrist joint to provide wrist supination/pronation movement during a flexion/extension cycle of the apparatus. In this regard, the provision of wrist supination/pronation in addition to elbow extension/flexion enhance functional patient rehabilitation. Again, in the preferred embodiment, a rotary actuator imparts torque to the forearm support which can be varied to adapt the apparatus for a particular patient. Limit switches may be provided to control the range of motion imparted by the motor means which can be adjusted from full flexion to full extension. Additional features make the apparatus safe and convenient to use as well as portable so as to enable the patient to perform rehabilitation exercises in a convenient and cost-effective manner in either supervised or non-supervised modes.

BRIEF DESCRIPTION OF THE DRAWINGS

The objects and advantages of the invention will become apparent upon a reading of the following detailed description thereof in accordance with the accompanying drawings wherein.

DETAILED DESCRIPTION OF THE INVENTION

This invention will now be described in detail with reference to a preferred embodiment thereof, and the best mode for carrying out the invention.

Figure 1:
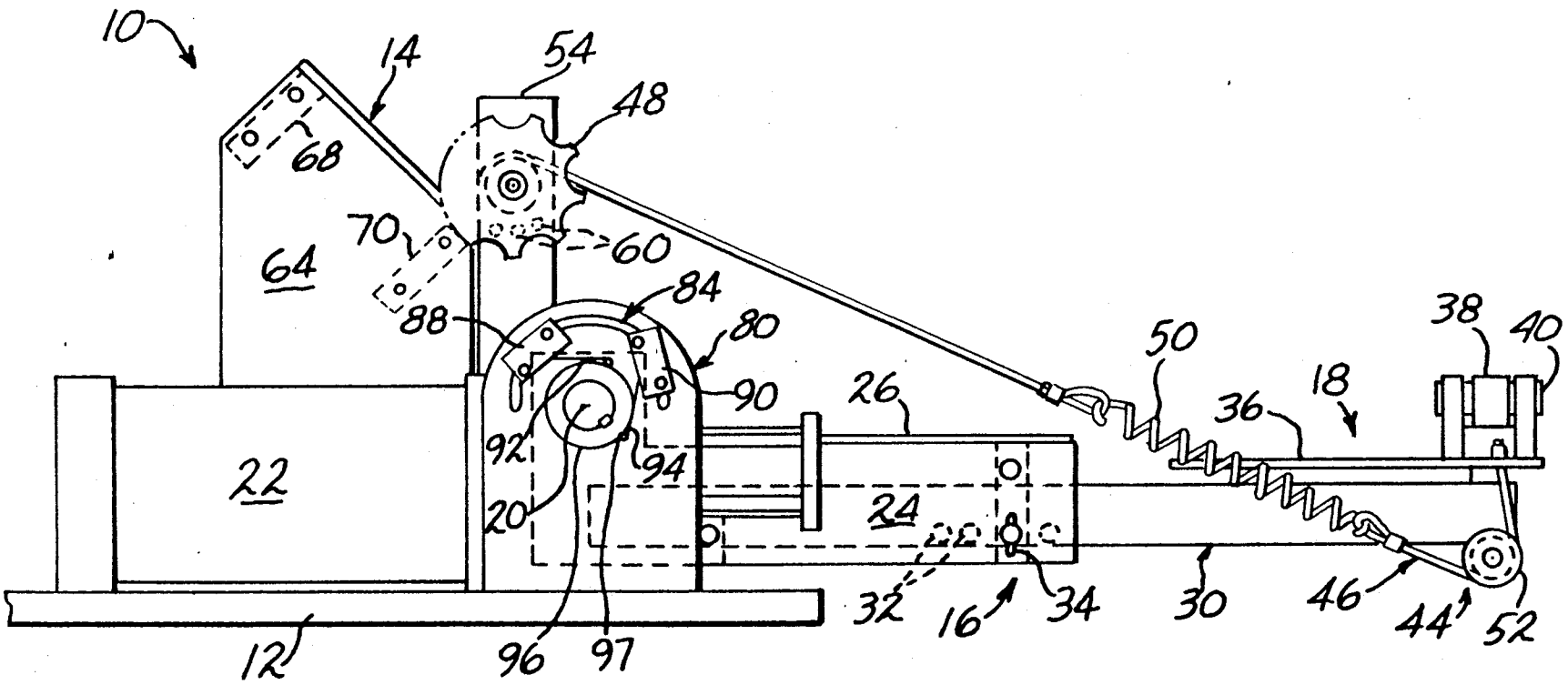
FIG. 1 is a side elevational view of the device according to the preferred embodiment thereof.
Figure 2:
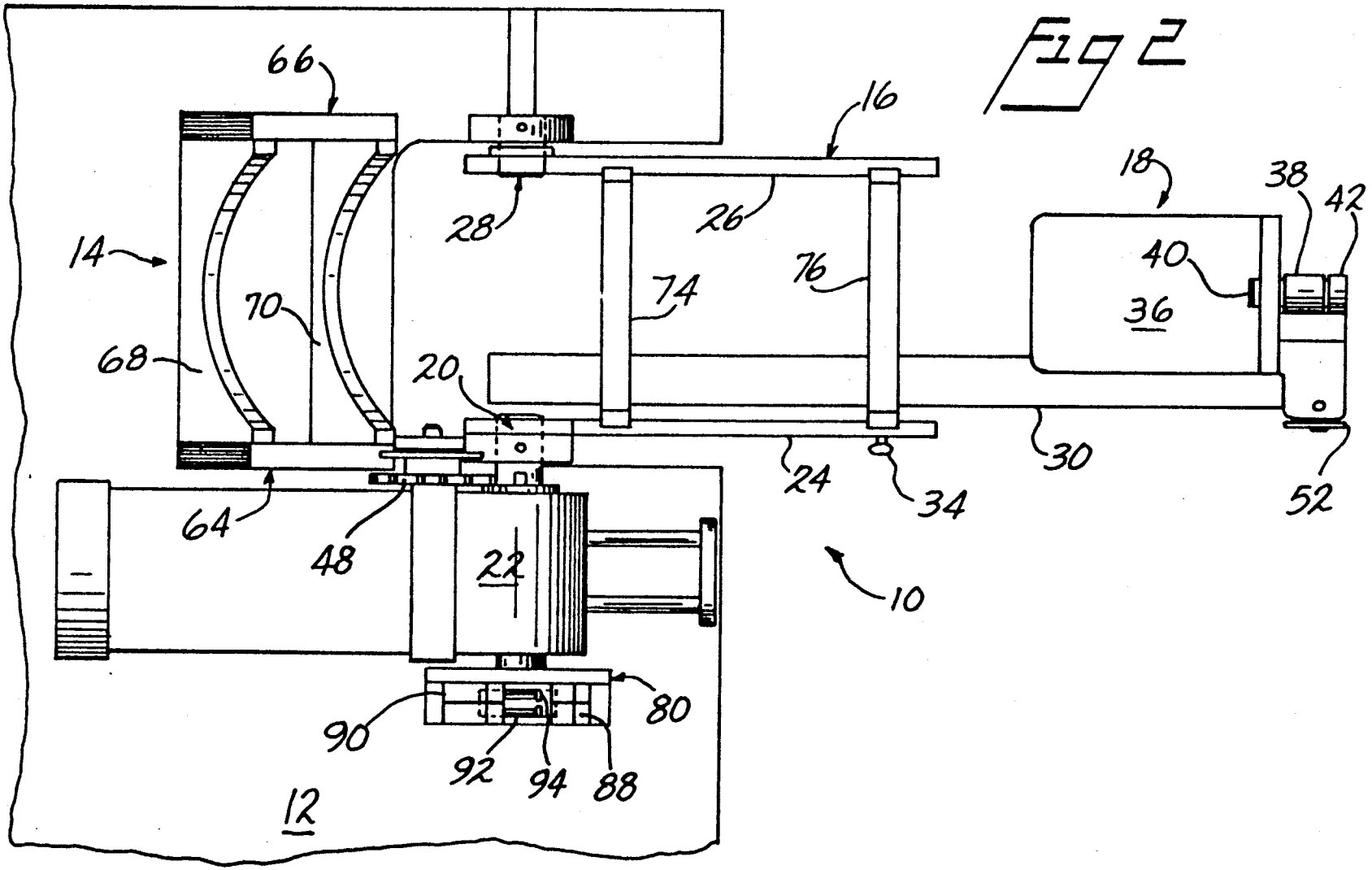
FIG. 2 is a top plan view of the device as shown in FIG. 1.
Figure 3:
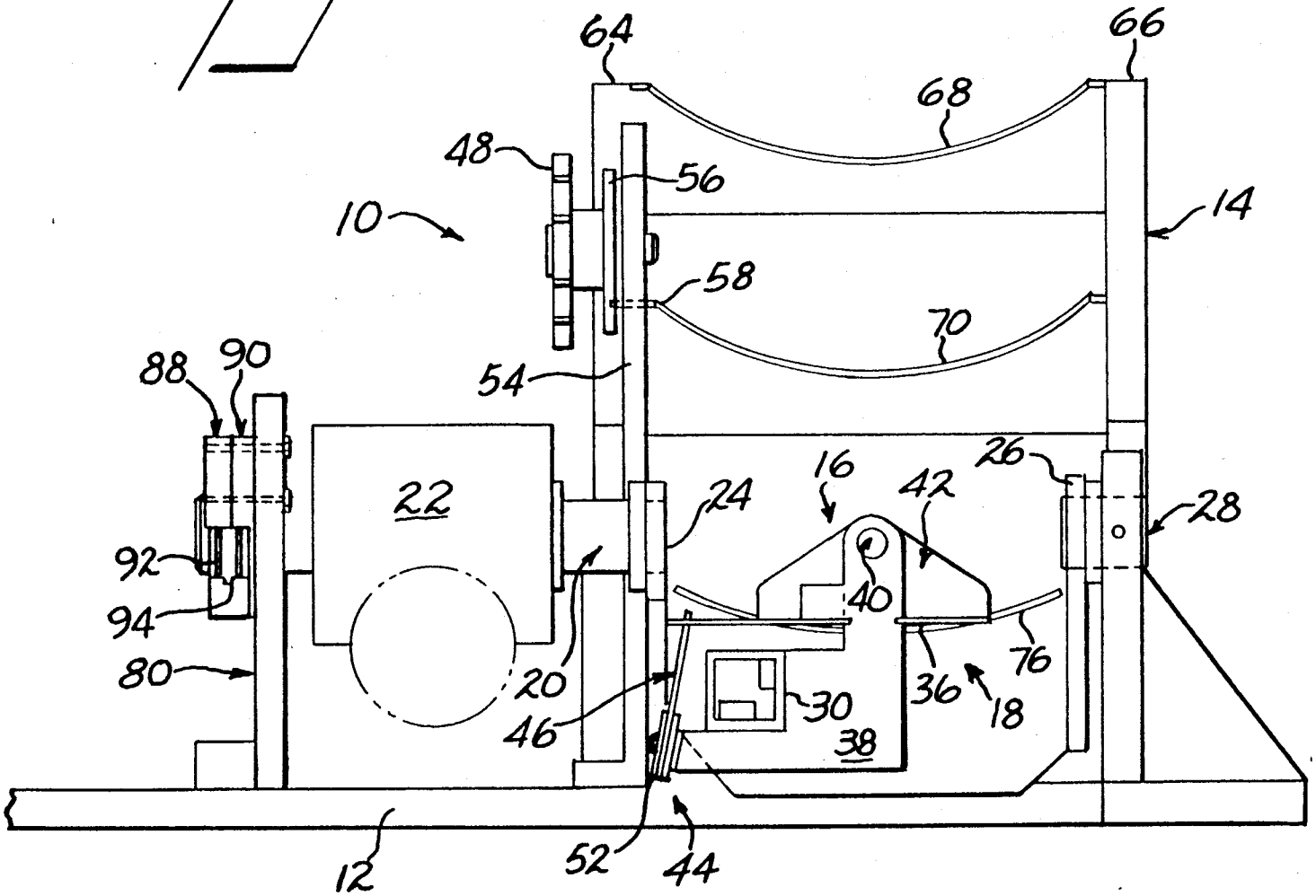
FIG. 3 is a front elevational view of the device shown in FIG. 1.

Referring to FIGS. 1–3, arm rehabilitation device 10 of this invention has a horizontal base plate 12, which supports a stationary upper arm supporting structure 14. Associated with the upper arm supporting structure 14 is a rotatable forearm supporting structure 16, which, when rotated, produces alternate flexion and extension of the patient's forearm as will be hereinafter described. The forearm support 16 includes a wrist stabilizer 18 which secures the wrist of a patient in a first position and allows pronation and supination of the wrist when desired. The forearm support 16 is rotatably coupled to the upper arm support 14 by means of a shaft 20. The shaft 20 comprises an output shaft of a rotary actuator 22 which acts to rotate the forearm supporting structure 16 back and forth through a predetermined angle of rotation, thereby causing alternate flexion and extension of the patient's forearm. A pneumatic control system and an electrical control system, which will be described in more detail as the description proceeds, are provided to allow selective and variable control of the rotary actuator 22 and operation of device 10. The device 10 as shown in these FIGS. is adapted to be used for the right arm of the patient, but it should be understood that the device is easily adapted for use with the left arm as desired.

According to the preferred embodiment, the basic elements of the device as described above will be set forth in more detail. The forearm support 16 comprises a pair of L-shaped members being right and left forearm support plates 24 and 26 which are parallel and spaced apart to receive the patient's forearm between them. The leg or longer portion of the members 24 and 26 extends longitudinally from near where the patient's elbow will be positioned and toward the distal end of the forearm. The foot or shorter portion of each of the forearm support plates 24 and 26 extends upwardly away from the base plate 12 and each has a bore at a top portion thereof. The shaft 20 is attached in the bore of the right forearm support plate 24 and a coaxial stub shaft 28 is secured to the bore of the left forearm support plate 26 as seen in FIGS. 2 and 3. The forearm support plate 24 is thus secured to the output shaft 20 of rotary actuator 22 to allow rotation about the axis of the shaft 20. The forearm support plate 26 is also secured to the rotatable stub shaft 28 or alternatively, the plate 26 may be itself rotatable relative to stub shaft 28 which may be a stationary shaft.

In use, the patient's forearm is positioned between plates 24 and 26 with the axis of refraction of the elbow being positioned coaxial with the axis of shafts 20 and 28. The forearm supporting structure 16 may also include a pair of spaced downwardly convexed forearm cradles 74 and 76 which are affixed to and extend transversely between the forearm support plates 24 and 26. A thin curved forearm rest (not shown) may be adjustably affixed to and supported by the forearm support cradles. Both forearm cradles 74 and 76 may also be cushioned with pads (not shown) for patient comfort. Wrap-around elastic straps (not shown) may be used to secure the patient's forearm in the forearm supporting structure 16 and those adjustable elastic straps, preferably of VELCRO, wrap around the forearm support structure with the patient's forearm positioned between the forearm support plates to secure and hold the forearm between the plates.

The forearm support 16 further includes a slide bar 30 which is adjustably affixed parallel to forearm support plate 24. The slide bar 30 may be supported on plate 24 by means of a channel structure (not shown) which is adapted to receive and support slide bar 30 so as to project beyond the end of the adjacent forearm support plate 24 and toward the wrist of the patient. The slide bar 30 is adapted for lengthwise adjustment to accommodate the length of the forearm of a particular patient by means of a series of collinear holes 32 along its length which correspond to a mounting hole in the support plate 24 to allow securing thereof at the desired position by a thumb screw 34 or the like.

The wrist stabilizer support bracket wrist stabilizer 18 includes a wrist stabilizer support support plate 36 which is attached to the distal end of the slide bar 30 by means of a bracket 38 as seen in FIG. 3. The bracket 38 supports wrist stabilizer shaft 40 which will be substantially coaxial with the patient's forearm and wrist. A clevis shaped wrist stabilizer support member 42 having a base and two forks of the clevis is provided, wherein each of the forks has a collinear bore designed to rotatably receive the wrist stabilizer shaft 40 journaled in the bores of the forks. The base of the wrist stabilizer support member is affixed to an offset portion of the wrist stabilizer plate 36 on which the patient's wrist will be secured and supported. The wrist stabilizer plate 36 will thus be rotatable about the axis of the wrist stabilizer shaft 40 in conjunction with support member 42 to allow selective pronation and supination movement of the patient's wrist around the axis of the wrist and forearm, which again coincides with the axis of the wrist stabilizer shaft 40.

In many therapeutical situations, pronation and supination of the forearm and wrist is essential to proper rehabilitation of the muscles in the arm. The device 10 therefore allows supination and pronation in conjunction with flexion and extension motions of the forearm, or alternatively only supination/pronation or flexion-/extension movement if desired. It should be understood that the wrist stabilizer 18 can be locked into an initial position by any suitable means if only flexion/extension movement is desired.

To accomplish the pronation/supination movement desired under many circumstances, the wrist stabilizer plate 36 is rotated by a force applying means 44 which comprises a cable assembly 46 connected at a first end to the wrist stabilizer plate 36 at an offset portion thereof so as to apply a rotational force to the plate 36. The cable assembly 46 is connected at its second end to a cable take-up reel 48, which is adapted to apply a pretension force to cable assembly 46. The cable assembly 46 may also include a tensioning means 50 associated therewith, which can be any elastic material, but in the preferred embodiment is shown as an extension spring. The cable assembly 46 is disposed around a pulley 52 which is rotatably affixed to the distal end of the wrist stabilizer bracket 38 such that the pulley 52 guides, directs and assists in tensioning the cable assembly 46 to apply the proper rotational force to wrist stabilizer plate 36 according to the needs of the patient. The cable take-up reel 48 is supported by a take-up bracket 54 affixed normally to the base plate 12 adjacent to the upper arm support 14. The cable take-up reel 48 may be configured as an automatic rewinding reel which is spring biased to constantly place tension upon cable 46 regardless of the position of the forearm support structure 16 and wrist stabilizing structure 18. Thus, during flexion movement of the forearm within the forearm support structure 16, the take-up reel 48 will automatically rewind to take-up any slack in the cable 46 and to apply a predetermined tension on cable 46.

To allow supination of the wrist, the initial amount of tension placed upon cable 46 to supinate the wrist at the point of full extension of the forearm is adjusted by means of hand positioning take-up reel 48 using the finger grooves therein, and securing a stationary back plate 56 in a fixed pre-tensioning position. The fixed back plate 56 of take-up reel 48 is secured by means of a locator pin 58 extending through bracket 54 and into one of a plurality of apertures 60 formed in the back plate 56 on which the automatic rewinding take-up reel 48 is rotatably positioned. It should of course be understood that a variety of other suitable means may be provided to pretension the cable 46 and to maintain a predetermined tension on the cable 46 throughout flexion and extension motion of the forearm support structure 16. By applying a predetermined tension to the cable 46, the proper amount of force is translated to the wrist stabilizer plate 36 on which the patient's wrist will be secured and supported to induce supination of the wrist during an operating cycle of the apparatus. The force applied by the cable 46 extending around pulley 52 to an offset portion of plate 36 will produce rotation of plate 36 on the shaft 40.

In operation, as will be hereinafter described in more detail, the patient's wrist is placed in a supinated position upon the wrist stabilizer support plate 36 at the fully extended position of the forearm, upon flexion movement of the forearm, the initial pre-tensioning force necessary to supinate the wrist is relaxed to some degree to allow the wrist to rotate along with the wrist stabilizer plate 36, to a pronated position. After completion of the flexion portion of an operating cycle, extension of the forearm will be performed, wherein the force applying means 44 will exert an increasing rotational force on the wrist stabilizer plate 36, to again supinate the wrist at the position of full extension.

Since it is imperative that the upper arm of the patient be stabilized to prevent subluxation of the shoulder during operation, the upper arm supporting structure 14 includes a pair upright parallel upper arm supports 64 and 66 mounted perpendicularly to the base plate 12 a distance apart to receive a patient's upper arm therebetween. The patient's upper arm is secured between the upper arm supports by a pair of spaced upper arm cradles 68 and 70 extending between supports 64 and 66 and having downwardly convexed upper edges. A cylindrically curved thin upper arm rest (not shown) may be provided which will be adjustably affixed to and supported on the upper arm cradles 68 and 70. Since patient comfort is very important, both upper arm cradles 68 and 70 may be cushioned with pads (not shown). The thickness of the padding is varied not only for comfort but also to insure that the axis of rotation of the patient's elbow is centered between the machine shafts 20 and 28. While the patient's arm rests upon the upper arm cradles 68 and 70, it must be secured there and held in stationary position by means of adjustable elastic upper arm straps (not shown) which wrap around the upper arm supports and the patient's upper arm. Once again, these straps may preferably be VELCRO for ease of fastening.

In FIG. 1, side elevational view of the invention 10, there is shown a switch bracket 80 affixed normally to the base plate 12, with a bore through the outer end of the switch bracket having a support collar journaled in the bore to receive and hold the outer end of the rotatable shaft 20. At the outer end of the switch bracket 80, there is provided an arcuate slot 84 which is coaxial and proximate to the shaft 20. A pair of limiting switches 88 and 90 are adjustably mounted in each of the arcuate slot 84, each switch having an armature 92 and 94 projecting toward the shaft 20. Each of the limiting switches will define the range of motion for one of flexion or extension movement of a patient's arm. The shaft 20 itself, a portion of which extends outside the bore in the switch bracket 80, has a pair of repositionable switch cam brackets 96 which will rotate with shaft 20. The switch cam brackets 96 have small indentations 97 therein, which allow the armatures 92 and 94 of the limiting switches 88 and 90 to intermittently contact and actuate the switches 88 and 90. The position of the limiting switches 88 and 90 in the arcuate slots 84 and 86 allows simultaneous limiting and alternating of shaft motion to likewise limit the range of motion of the patient's forearm. The apparatus using switches 88 and 90 will allow a full range of motion for flexion and extension of the patient's arm which normally ranges about 140° of rotation. The slot 84, in which switches 88 and 90 are positioned extends over a 180° arc such that up to 180° of rotation will be provided. Alternatively, the switches 88 and 90 may be positioned to allow a limited amount of flexion and/or extension depending on the particular needs of a patient.

For example, if a patient is experiencing spasticity which would cause the muscles of the arm to contract and follow various synergies, a therapeutic response consists of moving the arm while following the synergies so as to avoid moving the arm in non-synergy patterns which may result in a spasm. The device 10 allows the therapist or patient to set the range of motion of the forearm support 16 to simulate the range of motion experienced by the patient and to maintain or increase the range of motion to avoid permanent atrophy of muscles. The device 10 may be utilized to provide a constant stretch at a desired force to contracted muscles in the arm which inhibits muscle stimulation and may decrease muscle tone in the spastic patient as desired. Alternatively, a full range of motion may be provided for a flaccid patient to increase muscle tone and maintain the full range of motion as desired.

Figure 4:
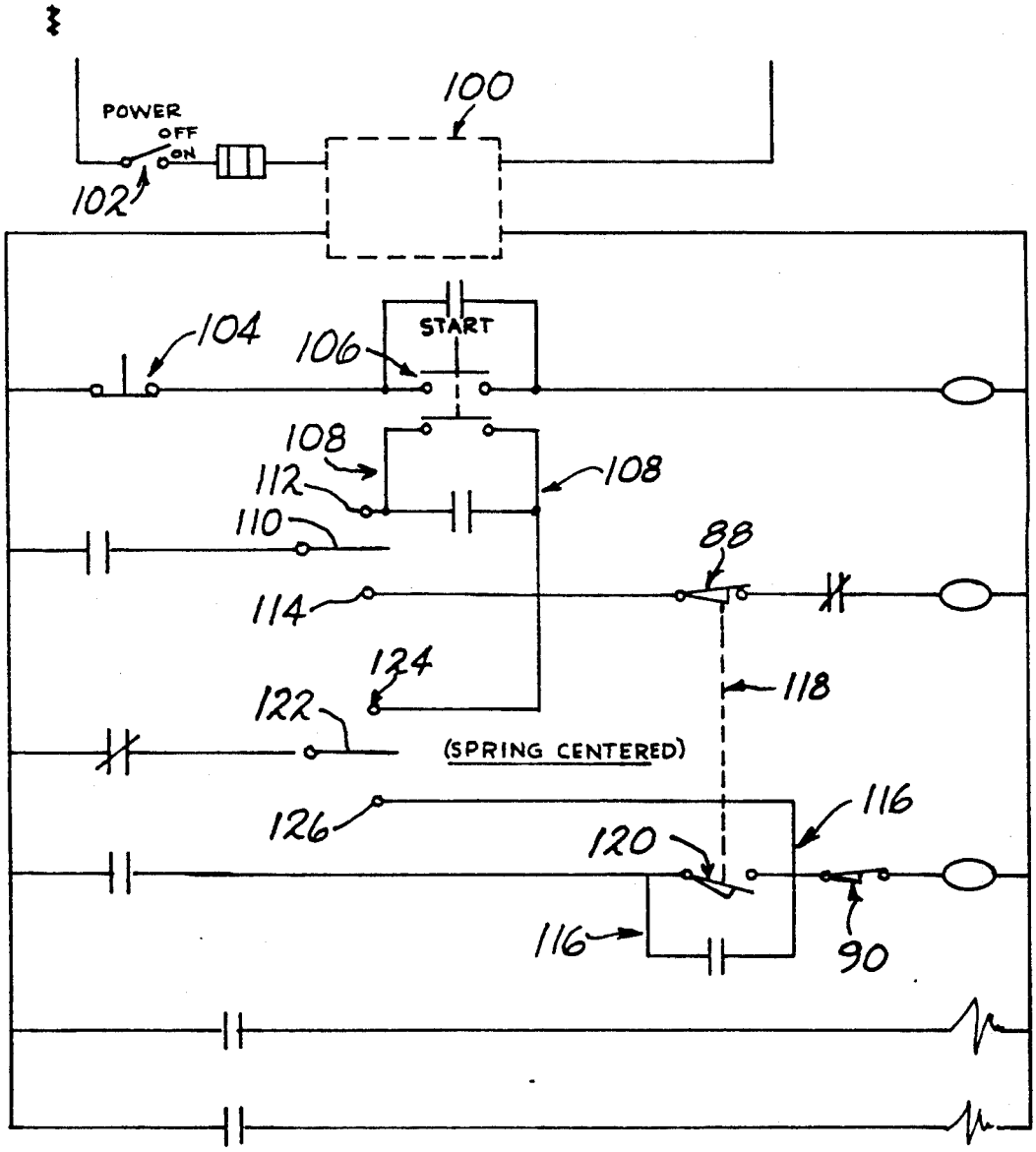
FIG. 4 is a schematic diagram of the electrical control system for the device as seen in FIG. 1.

The limit switches 88 and 90 are part of an electrical control circuit with is schematically shown in FIG. 4. As mentioned briefly before, the device 10 will necessarily be required to adapt to a particular patient's needs and therapeutic goals, one of which includes range of motion exercises for which the limit switches 88 and 90 are utilized. Additionally, for many patients, therapy consists of repeatedly cycling a patient through a preset range of motion, and the device 10 therefore includes an automatic mode. The automatic mode allows the therapist to cycle the patient through the desired range of motion for a desired number of cycles without the therapist having to perform the therapy personally, and also allows the patient to conduct therapeutic exercises themselves on a daily basis for optimal recovery from the nerve damage. Alternatively, particularly for the spastic patient or when initially setting the machine to the range of motion for a particular patient, manual operation may be desired. During manual operation, the apparatus 10 can be stopped at any point along a flexion or extension cycle to allow the patient a constant stretch as will be desired under many circumstances. Additionally, a major consideration for any device of this nature is the safety and comfort provided to the patient. The apparatus 10 is therefore provided with an emergency stop switch which will halt any motion of the apparatus immediately. It was also desired to eliminate any potentional hazard to the patient, and therefore the electrical circuit runs on a low power source to insure safety.

Turning to the schematic diagram of the circuit in FIG. 4, a power source, which may be a 12 volt DC power supply is provided at 100. For convenience, the power supply 100 may be a 12 volt DC transformer using a common 115 volt AC power source from a household wall outlet. A switch 102 may be provided to supply operating voltage to the circuit when use of the apparatus 10 is desired. An emergency stop switch 104 is provided to allow the motion of the forearms support 16 to be stopped immediately at any point during a cycle. The switch 104 may be a momentary switch of the double pull double throw type or any suitable switch which will allow operating power to be supplied to the circuit until the user selectively interrupts the circuit via the switch 104. Operating power is supplied through switch 104 to a first control relay 106 which permits switching control between actuating circuits of the device. The relay 106 is a latching relay which assumes a first or second attitude when energized and maintains the initiated position after control power is interrupted. The user of the apparatus 10 can provide energizing voltage to relay 106 to start operation of an initial cycle of the device. Relay 106 may be a 12 volt DC relay of the triple pull double throw type, and is operatively coupled to a second control relay 108 which may be of the 12 volt DC double pull double throw type. A switch 110, which may be a two position rocker switch of the single pull double throw type, is connected to the voltage supply and is selectively positioned between a first terminal 112 and second terminal 114 of the control relay 108.

Connection of switch 110 to terminal 112 will connect control relay 108 to the power supply to be energized, so as to begin a cycle of movement via the rotary actuator 22. The control relay 108 is operatively coupled to solenoid controlled values of the rotary actuator 22 to initiate rotation of the output shaft 20 so as to rotate the forearm supporting structure 16 downwardly. The control relay 108 is electrically connected to the rotary actuator 22 by means of a first of the limit switches 88 which is set so as to allow movement of the forearm support 16 to the desired downward extent. The limit switch 88 will remain closed until the full "down" position is reached, and thus the control relay 108 will remain energized until the limit switch 88 has been opened at the full "down" position. It should be recognized that via the rotatable switch cam brackets 96, that the position at which limit switch 88 will be triggered to an electrically non-conducting state may be varied to adjust the extent of the downward motion of the forearm support 16. By positioning the rocker switch 110 at terminal 112, one downward cycle of the forearm support 16 will be performed, wherein the limit switch 88 will deactivate the control relay 108 upon reaching the full downward position.

Alternatively, the rocker switch 110 may be switched to terminal 114 to place the operating circuit in an automatic mode wherein cycling of the forearm support 16 is repeated indefinitely or a desired number of times. In the automatic repeat mode, operating voltage is supplied through control relay 108 to affect downward motion of the forearm support 16 until limit switch 88 is again tripped. Limit switch 88 is operatively coupled to a terminal of a third control relay 116 as shown schematically by connection 118 such that upon reaching the full closed position at which limit switch 88 will be opened, switch 120 of control relay 116 will be closed. Thus, when the forearm support 16 reaches the full down position, the limit switch 88 is opened and switch 120 is closed simultaneously. The control relay 116 is operatively coupled to the rotary actuator 22 so as to induce rotation of shaft 20 in the opposite direction of control relay 108 to impart upward motion to the forearm support 16. The second limit switch 90 is associated with the control relay 116, and is normally closed until the forearm support 16 reaches the full up position as set by the switch cam bracket 96 associated with limit switch 90. The control relay 116 will remain energized until the full up position has been reached by the forearm support 16, at which limit switch 90 will be opened along with switch 120 of control relay 116, and control relay 108 will be re-energized to begin downward motion of the forearm support 16 and continue cycling of the apparatus.

As previously mentioned, it may also be desirable to manually control the rotary actuator 22 to allow selective upward or downward motion of the forearm support 16. A switch 122, which may be a three position rocker switch being spring centered to a neutral non-conducting position relative to terminals 124 or 126 of the circuit. If an operating cycle of the device comprises full upward and downward movement of the forearm support 16, it is desired to provide selective half cycle movement of either upward or downward motion for various purposes. The switch 122 may be connected to terminal 124 so as to energize control relay 108 to perform a single downward cycle of the forearm support 16. It will be recalled that the limit switch 88 will short the circuit upon reaching the full down position, to de-energize the control relay 108. Alternatively, switch 122 may be connected to terminal 126 which will energize control relay 116 and perform a single upward half cycle, wherein the limit switch 90 will act to de-energize the control relay 116 upon reaching the full up position. It should be recognized that the particular electrical control circuit described herein is only one possible embodiment and shows a relatively simple and straightforward circuit to accomplish various control features. It would be obvious to modify the control circuit to include additional functions or other operations as may be particularly desired for an individual patient or as a standard feature of the device.

Another important aspect of the device is the pneumatic control system of the preferred embodiment which has been designed to insure patient safety and comfort. For each individual patient, the torque applied to a patient's arm should be variable over a wide range to accommodate either the flaccid or spastic patient as well as the varying degrees of recovery which any individual patient has achieved. Thus, the torque produced by the rotary actuator 22 of the device can be varied from 0 to 500 inch-pounds or more as an example. The particular torque which is used by a therapist or patient will depend upon the strength of the patent as well as the particular therapy which is to be conducted using the device. In the preferred embodiment, pneumatic power has been chosen as the best choice for achieving portability of the device. Portability is facilitated in that air lines are normally available in most hospitals, and the air driven rotary actuator 22 could also be driven by a small compressor or even a pressurized air tank for home use. It also has been noted the pneumatic power is clean, and any possible leakage problems would not require any additional precautionary measures. Also in the pneumatic system, lubricated and moving parts are kept to a minimum to avoid possible breakdown of the system. It is an additional feature of the pneumatic control system that the therapist is able to effectively vary the speed of motion so as to suit an individual patient's requirements and abilities.

Figure 5:
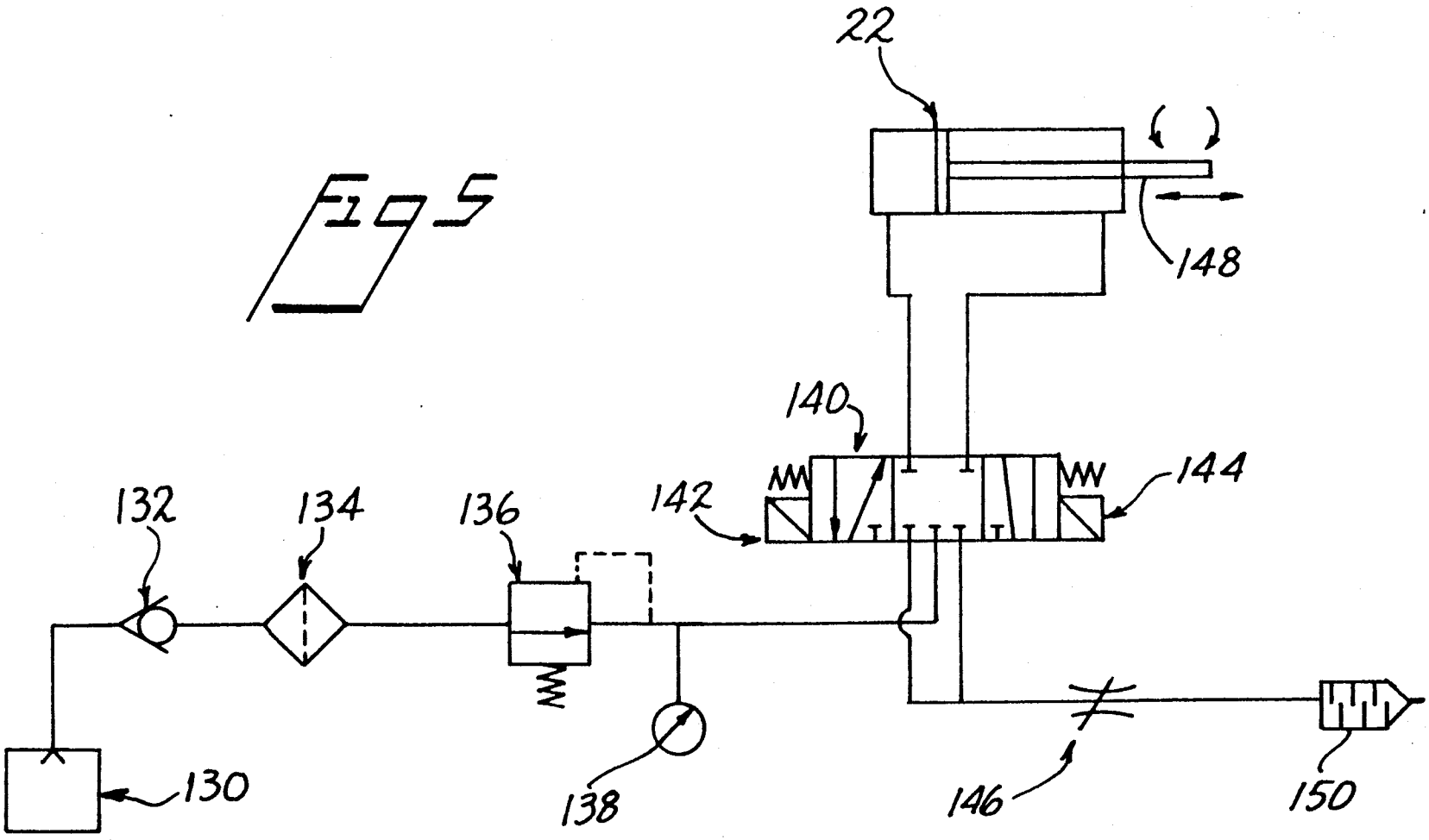
FIG. 5 is a schematic diagram of a pneumatic control system for the device as shown in FIG. 1.

As seen in FIG. 5, the pneumatic control circuit is supplied with a fluid under pressure such as through pressurized air source 130, which supplies air at a predetermined pressure as for example 100 psi. A one-way valve 132 is provided in the pneumatic line along with a filter 134 used to remove any debris or moisture from the pressurized air. A pressure regulator 136 is utilized to vary the torque produced by the rotary actuator 22, and thus adjusts the force exerted on the patient in a desired manner. The pressure regulator 136 may be controlled by a suitable user switch mounted on a control panel of the apparatus to allow easy and effective adjustment of the torque produced by the rotary actuator 22. A pressure gauge 138 may be provided downstream from the pressure regulator 136 to monitor the pressure at which the apparatus is set to yield the desired torque or force upon the patient's arm. The regulated air supply is then directed to a directional valve 140 which may be a 4-way, three position double solenoid valve having solenoids 142 and 144 associated therewith which are coupled to the electrical control circuit and control relays thereof as previously described. The solenoids 142 and 144 thereby selectively actuate a plurality of valves within the directional valve 140 to selectively supply air under pressure to the rotary actuator 22 to induce rotation of the output shaft 20 in the desired direction at the desired speed. The pneumatic circuit also includes a flow control valve 146 which is used to adjust the speed of one cycle of the apparatus between desired extremes. For example, the speed of one cycle may be varied from 4 to 60 seconds, which allows the therapist or patient themselves to properly adjust operation of the machine for their particular needs and capabilities. The flow control valve 146 is coupled to the directional valve 140 on an exhaust port line of the directional valve 140 so as to allow bleeding of the pressurized fluid and the ability to adjust speed of operation. The flow control valve 146 may be a needle valve which is user adjustable by suitable means provided on a control panel of the apparatus. The flow control valve 146 was designed to be placed on the exhaust port line of the directionally valve 140 so as to establish back pressure in the pneumatic circuit. With the flow control valve 146 on the exhaust port of the directional valve 140, pressure is provided on both sides of the actuator piston 148 of the rotary actuator 22. In this way, the pneumatic circuit provides stability in the operation of the device and prevents any sudden or extreme movements in resulting operation of the apparatus. An exhaust muffler 150 may be provided on the pneumatic circuit so as to yield a quiet and effective means to control movement of the forearm support 16.

In operation of the apparatus, the patient's upper arm is placed between the right and left upper arm supports 64 and 66 with the back of the arm supported against an upper arm rest, padding or both placed on cradles 68 and 70. The upper arm is positioned such that the axis of rotation of the patient's elbow is coaxial with shafts 20 and 28, and may be secured in this position by means of adjustable VELCRO straps or the like. A bottom adjustable elastic wrap around strap is placed in a position directly against the patient's arm, so that it compresses the biceps tendon (the tendon that inserts the biceps on the bicipital tubercle of the radius). By placing a retaining strap in this position, the muscles of the arm are relaxed to some degree as pressure on this tendon inhibits muscle stimulation. The upper arm support also insures that the patient's shoulder and upper arm are stabilized to prevent subluxation of the shoulder. The length of the machine is adjusted to fit the patient's arm by lengthening or shortening the slide bar 30 and the slide bar is secured at the appropriate length. The wrist is then positioned on the wrist stabilizer plate 36 such that the back of the hand lies against the plate and the wrist is supinated. The wrist supination force is adjusted by rotating the cable assembly take-up spool 48 to the desired tension setting and the locator pin 58 is inserted in the support bracket 54. Since it is beneficial to relax the muscles of the hand and arm as much as possible, a stretching cone (not shown) can be placed in the patient's hand and both are secured to the wrist stabilizer plate 36 by means of elastic straps (not shown) which, in the preferred embodiment, may be VELCRO straps. The cone supplies a constant stretch to the muscles of the hand during therapy.

After the patient's arm has been secured in the upper arm supporting structure 14 and forearm supporting structure 16 in the proper position and in a comfortable manner, set up of operation of machine may then be performed by the therapist or the patient himself. The following proposed procedure assumes a spastic patient, wherein the rehabilitative exercises may include flexion and extension of the arm over a limited range of motion, with the speed and force at which the patient's arm is moved being set so as to follow the particular patient's flexor synergy in a precise and controlled manner. A similar set up procedure would be followed for a patient with a flaccid condition, except that the speed setting of operation would not be as critical since the flaccid arm can be moved quickly without over-stimulation.

In the set up of the apparatus, the pneumatic circuit as described with reference to FIG. 5 is connected to an air line or air compressor to provide a source of air under pressure. The pneumatic circuit is adjusted such that the speed and force are initially set to zero. The force is set to zero by closing the pressure regulator 136 which allows adjustment of the torque output of the rotary actuator 22 through the output shaft 20 associated therewith. The speed may also be set to zero by closing the flow control valve 146, such that no pressure is applied to the rotary actuator 22 through the directional valve 140. When the apparatus is initially set up in this mode, the therapist may then set the limit switches 88 and 90 for the desired range of motion through which the patient's arm is to be moved. The range of motion may be determined by physically moving the patient's arm in its secured position within the apparatus to determine the abilities or limitations of the patient. After the limit switches have been positioned for the desired range of motion, the therapist may switch the apparatus on by means of switch 102 to couple power to the electrical circuit as shown in FIG. 4, of the apparatus and using switch 122 may place the device in the manual mode to perform either a flexion or extension movement of the patient's arm. The force applied to the patient's arm via the forearm support assembly 16, is set at a very low setting initially, and slowly increased to determine the patient's lowest setting for the desired exercise. Alternatively, if the patient's lowest setting is known, the therapist or patient may set the force to this setting initially. Once the force for the exercise movement has been set, the patient is cycled through one full cycle of flexion and extension using the manual mode via switch 122 to insure proper operation of the apparatus. If the patient experiences no abnormal pain or sensation after one cycle, the apparatus may then be switched to automatic mode via switch 110 to begin automatic cycling of the patient's arm through the desired exercise movement. Once the apparatus is turned to the automatic mode, the speed of movement may be turned up slowly by adjustment of the flow control valve 146 until the desired speed is obtained. The range of motion setting is verified by the therapist or patient and cycling of the patient's arm continues. Cycling may continue indefinitely or the electrical circuit may be provided with a counter to affect automatic stopping of exercise motion after a predetermined number of cycles.

Before the foregoing procedures are utilized to provide therapy to a particular patient, the following tests must be performed to obtain the optimum benefits from the exercise movement. Firstly, a range of safe pressures corresponding to patient's strength must be determined for a particular patient. This test would establish the different torques or pressures supplied from or to the rotary actuator 22 respectively, which are needed to overcome the muscle resistance of the arm for a spastic patient for example. Further, a test to determine the spring stiffness of the wrist supination structure may be necessary to insure the proper pronation/supination movement during a cycle of the apparatus, such as during a limited range of motion exercise. It may be that the spring 50 will be required to be changed to adjust the spring constant within the force applying means 44, or alternatively the position at which the cable take up reel 48 will initially be set to apply the proper pretensioning force for proper wrist supination. This test would establish the force (or spring constant) needed to supinate the wrist at varying degrees of extension. It may also be conducted a test to establish the correlation between cycle time and position of the flow control valve 146 to obtain the cycle time desired for the particular patient. It should be understood that each of the control variables associated with the apparatus such as torque applied to the patient's arm, cycle speed, spring constant of the wrist supination device as well as the range of motion for a particular patient can be quantified by means of relative or actual scales associated with each of the control means allowing the user to vary these characteristics. The control panel could be inscribed for speed and force settings as well as on the switch bracket 80 the supporting the limit switches 88 and 90 and on the springloaded cable take-up reel for example. By providing quantitative measurements, the therapist can quantitatively evaluate the patient's progress in the degrees of recovery of the patient. As an example, the apparatus may be utilized to exert a constant known force against a limb of a spastic patient, wherein the amount of displacement or angle of rotation achieved in the apparatus may be measured to monitor and evaluate the progress of the patient. Alternatively, the apparatus could be utilized to move a patient's limb a given displacement with the resistance force exerted on the apparatus by the patient's muscles being measured by suitable measuring means supplied with the apparatus. Again, the progress made in relaxing the muscles of the limb may be monitored in a quantitative fashion. Alternatively, for the flaccid patient, the apparatus may be used to measure the strength of the muscles during recovery, for example by monitoring the angle of rotation achieved when the patient attempts to extend of flex the arm, as well as measuring the spring constant necessary to achieve supination of the arm in the device.

It is to be understood that the above description of the present invention is a preferred embodiment and is in no way intended to limit the invention. Various changes, modifications and adaptions would be obvious to one skilled in the art, and as such are intended to be included within the meaning and range of equivalents of the following claims.

What is claimed is:

1. An arm rehabilitation device to exercise arm muscles of a patient, comprising:

a base having an upper arm support means affixed thereto, being disposed to receive and hold the patient's upper arm in a stationary position;

a forearm support means rotatably coupled to the upper arm support means, adapted to receive and support the patient's forearm;

a means for selectively rotating the forearm support means to provide flexion and extension of the patient's arm;

a wrist support means rotatably mounted to the forearm support means and adapted to rotate about an axis which is substantially coaxial with the patient's forearm; and, a force applying means for rotating the wrist support means to provide selective pronation and supination of the patient's wrist.

2. The device described in claim 1, wherein the means for rotating the forearm support means and force applying means for rotating the wrist support means operate in conjunction with one another to allow flexion/extension motion and pronation/supination motion to be achieved simultaneously or by solitary operation.

3. The device described in claim 1, wherein the means for selectively rotating the forearm support means is a pneumatically driven rotary actuator having a rotatable shaft associated therewith which is coupled to said forearm support means, and a means for limiting and alternating shaft rotation to control range of motion for forearm flexion and extension movements.

4. The device described in claim 3, wherein the forearm support means includes first and second forearm support plates spaced apart to receive the patient's forearm and extending longitudinally from near the patient's elbow toward the distal end of the forearm, each forearm support plate having a bore near the proximal end with the first support plate being secured to the shaft of said rotary actuator and a stub shaft being coaxial with the shaft of the rotary actuator secured to the second support plate to allow rotation about the axis of the shafts approximately coaxial with the patient's elbow.

5. The arm rehabilitation device described in claim 1, wherein the force applying means is adapted for rotation of said wrist support means and comprises a take-up bracket affixed to the base;

a take-up spool, rotatably mounted on the take-up bracket;

a cable assembly having a first end attached to the take-up spool and a second end attached to the wrist support means, said cable assembly having a tensioning means associated therewith;

a pulley rotatably affixed adjacent to the wrist support means, with the cable assembly being drawn through the pulley to guide the cable assembly so as to exert a rotational force on said wrist support means.

6. The arm rehabilitation device described in claim 5, wherein the tensioning means of said cable assembly is a removable spring to allow a selected pre-tensioning force to be applied to said wrist support means.

7. The arm rehabilitation device described in claim 1, wherein the forearm support means and upper arm support means include a plurality of spaced, downwardly convex forearm cradles adapted to support the forearm and upper arm respectively; with an adjustable securing means associated with each of the forearm and upper arm support means to securely hold the patient's forearm and upper arm.

8. The arm rehabilitation device described in claim 3, wherein the means for limiting and alternating shaft rotation is a pair of limiting switches adjustably mounted adjacent said shaft, each limit switch having an armature projecting toward the outer end of the shaft;

the shaft having a switch-cam bracket rotatable therewith which is contacted by armatures of the limiting switches and adapted to actuate the limit switches to limit alternate shaft rotation and concomitantly limit the range of motion of the forearm support means.

9. The arm rehabilitation device described in claim 5, wherein said take-up spool may be rotated to provide a pre-tensioning force on said cable assembly and an indicating means is provided to record the position of said spool as an indication of cable tension.

10. The arm rehabilitation device described in claim 3, wherein the rotary actuator includes a pneumatic drive means comprising a source of air under pressure coupled to a pressure regulator, said pressure regulator having control means to vary the pressure of air supplied to the rotary actuator, said pressure regulator coupled to a control valve which selectively supplies air under pressure to drive the rotary actuator;

said control valve also being coupled to an adjustable flow control valve which allows the rotational speed of the rotary actuator to be selectively varied.

11. The arm rehabilitation device described in claim 1, wherein the rotatable wrist support means includes a slide bar adjustably mounted to said forearm support means and adapted for lengthwise adjustment relative to said forearm support means to conform to the length of the forearm of the patient;

a wrist stabilizer support bracket coupled to the distal end of the slide bar, said bracket having a bore therethrough at its outer end to receive and support a wrist stabilizer shaft journaled in the bore in substantially coaxial relationship with the patient's forearm positioned in said forearm support means;

a rotatable clevis shaped wrist stabilizer support having a base, each fork of the clevis having a collinear bore therethrough to receive said wrist stabilizer shaft; and, a wrist stabilizer plate coupled with the wrist stabilizer bracket to allow rotation of said plate therewith for pronation and supination movements of the wrist.

* * * * *